US005425570A

United States Patent [19]

Wilkinson

[11] Patent Number: 5,425,570

[45] Date of Patent: Jun. 20, 1995

[54] METHOD AND APPARATUS FOR PLASMA BLASTING

[75] Inventor: Gregory M. Wilkinson, San Diego, Calif.

[73] Assignee: Maxwell Laboratories, Inc., San Diego, Calif.

[21] Appl. No.: 193,233

[22] Filed: Jan. 21, 1994

[51] Int. Cl.[6] ..... E21C 37/18; E21B 7/15

[52] U.S. Cl. ..... 299/14; 166/63; 166/299; 175/16

[58] Field of Search ..... 299/14; 175/16; 166/63, 166/299, 294

[56] References Cited

U.S. PATENT DOCUMENTS

| | | | |
|---|---|---|---|
| 3,583,766 | 6/1971 | Padberg, Jr. | 299/14 |
| 3,679,007 | 7/1972 | O'Hare | 175/16 |
| 4,334,474 | 6/1982 | Coltharp | 102/206 |
| 4,343,356 | 8/1982 | Riggs et al. | 166/249 X |
| 4,479,680 | 10/1984 | Wesley et al. | 166/299 X |
| 4,741,405 | 5/1988 | Moeny et al. | 175/16 |
| 4,897,577 | 1/1990 | Kitzinger | 315/55 |
| 4,974,487 | 12/1990 | Goldstein et al. | 89/7 |
| 5,052,272 | 10/1991 | Lee | 89/7 |
| 5,072,647 | 12/1991 | Goldstein et al. | 89/8 |
| 5,083,615 | 1/1992 | McLaughlin et al. | 166/299 |
| 5,106,164 | 4/1992 | Kitzinger et al. | 299/14 |

FOREIGN PATENT DOCUMENTS 357345 7/1983 U.S.S.R. .

*Primary Examiner*—David J. Bagnell

*Attorney, Agent, or Firm*—Fitch, Even, Tabin & Flannery

[57] ABSTRACT

Method and apparatus for plasma blasting comprises a capacitor bank for storing electrical charge to which is coupled an inductance which delivers the electric charge as a current through a switch to an explodable conductor comprising a portion of a probe. The explodable conductor is a ribbon helically wound on a cylindrical mandril, the ribbon having a given length to cross section ratio which is proportional to the square root of the ratio of the inductance to the capacitance in order to ensure efficient dissipation of an optimal amount of the electrical energy stored in the capacitance.

9 Claims, 11 Drawing Sheets

METHOD AND APPARATUS FOR PLASMA BLASTING

BACKGROUND OF THE INVENTION

The invention relates in general to an apparatus for plasma blasting comprising a driver for supplying pulsed high current to a probe to create a plasma for fracturing a geological formation by shock waves resulting from the plasma. More particularly, the invention relates to an apparatus wherein the driver has a capacitance for storing a large amount of electric charge at high voltage. An inductor of the driver carries the discharge current pulse from the capacitance and delivers it to an electrically matched removable explodable conductor coupled to the probe. The explodable conductor is positioned within a bore of the geological formation or other solid material.

Both exploding wire and spark gap systems are known for producing an explosion or the venting of a propellant gas. Exploding wire systems are exemplified by U.S. Pat. No. 5,052,272 to Lee for Launching Projectiles With Hydrogen Gas Generated From Aluminum Fuel Powder/Water Reactions. Lee discloses a method of generating hydrogen gas with high energy efficiency by applying pulse power techniques to a trigger wire and an aluminum fuel powder-oxidizer mixture. The preferred oxidizer of the aluminum fuel powder is water. The apparatus includes a capacitor bank connected to an induction coil. A metal conductor wire is connected to the induction coil and a fast switch. When the switch is closed, electrical energy from the capacitor bank flows through the inductor and the switch as well as the wire. The total energy of the electrical discharge is preferably from 0.50 to 15 kilojoules per gram of aluminum fuel. The discharge lasts between 10 and 1000 microseconds.

U.S. Pat. No. 3,583,766 to Padberg, Jr. discloses a deep submergence search vehicle having a drill pipe into a bore formed in a layer of mineral deposits and extending into a sedimentary ocean bed. A drill head is positioned at the lower end of the drill pipe with a plasma discharge section positioned above the drill head. An energizing circuit couples electrical energy from a power source to a thin nickel wire extending through the plasma discharge section. When a switch is closed, a high current is suddenly passed through the thin nickel wire exploding it and creating a large plasma discharge accompanied by sharp pressure waves. Openings in the plasma discharge section allow the pressure waves to emerge and produce a rapidly expanding and collapsing gas bubble with accompanying shock waves simulating those of explosives. The alternate bubble expansion and collapse propagates acoustic waves in the form of sharp pressure pulses.

Soviet Union No. SU 357345 A to Yutkin discloses a rock breaking device having a pair of electrodes and a conductive wire strip for insertion in a hole in rock filled with a wetted dielectric bulk material, such as sand, to produce shock waves when energized. The wire is connected to the electrodes and stretched around a dielectric plate. The dielectric plate is positioned in the rock hole for bursting operation.

Spark gap or non-exploding wire systems are exemplified by U.S. Pat. No. 3,679,007 to O'Hare for Shock Plasma Earth Drill which discloses a spark gap probe for drilling deep holes in the earth for the recovery of water or oil. The probe has a center electrode separated from and surrounded by an outer electrode. A condenser or capacitor bank having a capacitance of 400 microfarads and charged to a potential of 6000 volts supplies electrical energy to the electrodes. Shock waves were generated in water the outer surface of the center electrode and the inner surface of the surrounding electrode separated by a gap of 0.75 inch. The center electrode had a diameter of 0.25 inch. The embodiment shown in FIG. 4 has a capacitor or condenser bank charged to 6000 volts or more by the combination of high voltage rectifier and high voltage transformer. In the embodiment shown in FIG. 5 a capacitor bank may be charged to 6000 volts for working in soft earth and higher voltages of 30,000 volts or more for working in harder soil or rocky areas. In each of the embodiments when a switch is closed an initial surge of voltage reaches the electrodes positioned in water. The resistance of the water is lowered as the water is converted to plasma by the electric current pulse. Rapid release of electrical energy across the resistance of the water plasma produces a large amount of heat to produce an explosive effect that impacts and thrusts aside the earth ahead of the electrode.

U.S. Pat. No. 4,741,405 to Moeny et al. discloses a spark discharge drill for subterranean mining. The drill may deliver pulses of energy ranging from several kilojoules up to 100 kilojoules or more to a rock face at the rate of 1 to 10 pulses per second or more. A drilling fluid such as mud or water assists propagation of spark energy to the rock face.

U.S. Pat. No. 4,897,577 to Kitzinger for Electromechanically Triggered Spark Gaps discloses an anode and a cathode having facing surfaces defining a gap. A trigger electrode is located in the vicinity of the gap. A piezoelectric generator connected between the trigger electrode and the cathode triggers the spark gap switch. The switch may handle currents on the order of 100,000 amperes or higher from a capacitor discharge circuit.

U.S. Pat. No. 5,106,164 to Kitzinger et al. for Plasma Blasting Method discloses a plasma blasting process for fragmenting rock in the practice of hard rock mining. Electrical energy from a capacitor bank is switched to supply 500 kiloamperes to a blasting electrode positioned within a bore in a rock face causing dielectric breakdown of an electrolyte, preferably containing copper sulfate, to form a plasma. The electrolyte may be gelled with bentonite or gelatin to make it viscous enough so that it will not leak out of the confined area prior to blasting. The blasting apparatus has minimal inductance and resistance in order to reduce power loss and ensure rapid discharge of energy into the rock.

One of the drawbacks of the prior art systems is that the energy transfer from the capacitance to the explodable conductor or spark gap is relatively inefficiently. As a result of the inefficient transfer of energy, it was necessary to provide relatively large capacitor banks for driving either the explodable conductor or the spark gap to provide a given amount of explosive energy.

The spark gap systems also suffer from the draw-back that the zone at which the energy is to be dissipated, that is the gap between the electrodes, initially has a high impedance followed by insulating breakdown at the gap due to the applied voltage with a relatively lower impedance plasma being formed. As a result, the change in gap impedance from high to low impedance does not dissipate energy at the gap as efficiently as an exploding wire system might.

SUMMARY OF THE INVENTION

The inventive method and apparatus comprises apparatus for plasma blasting having a driver circuit with a large multi-capacitor capacitor bank. The capacitor bank is connected to deliver current to a high current switch, such as an ignitron, controlled by a trigger circuit connected to a grid of the ignitron. A distributed inductance of the drive circuit when taken in conjunction with the large capacitance of the capacitor bank, results in a circuit having a relatively significant reactive impedance with a relatively low dissipative or resistive impedance.

In order to overcome the problems associated with the prior art, in particular the inefficient transfer of energy which necessitates the use of relatively large capacitance systems to supply adequate energy to drive an exploding wire, an important feature of the instant invention lies in the use of the explodable conductor having a particular electrical relationship with the inductive and capacitive impedance components of the driver circuit. In particular, what has been discovered is that the explodable conductor should have a volume, as defined by the product of the fuse length (l) and the fuse cross sectional area (A), that is proportional to the stored energy in the capacitor bank $CV^2$ and a length to cross sectional area ratio which is proportional to the square root of the inductance of the distributed inductance divided by the capacitance. The length (l) is measured in the direction of current flow. The cross sectional area (A) is measured transverse to the direction of current flow. Combining the two equations fuse length (l) may be derived as equal to $$l=k_1(LC)^{\frac{1}{2}}V$$

and the fuse cross sectional area may be derived as $$A=k_2C^{\frac{3}{2}}L^{-\frac{1}{2}}V$$

where $k_1$ and $k_2$ are empirically determined constants. In the event that an aluminum fuse or explodable conductor is used $$k_1=1.8\times10^{-1}\ \text{cm/(volt-sec}^{\frac{1}{2}})$$

$$k_2=3.6\times10^{-5}\ \text{cm}^2\text{/(amp-sec}^{\frac{1}{2}})$$

and, in addition for copper $$k_1=2.3\times10^{-1}\ \text{cm/(volt-sec}^{\frac{1}{2}})$$

$$k_2=1.6\times10^{-5}\ \text{cm}^2\text{/(amp-sec}^{\frac{1}{2}})$$

It has also been found that the fuse length (l) is less critical than the cross sectional area.

In addition, the desired energy transfer is enhanced by selecting the explodable conductor characteristics such that it has a tendency to explode when peak current is flowing through the fuse. At that point, a large amount of current is flowing, the resistance of the plasma across the fuse site has increased when the solid explodable conductor is converted to a plasma thereby causing the $I^2R$ drop at the explodable conductor site to increase even further. This enhances the localized energy dissipation at the fuse site with respect to energy dissipation in other portions of the circuit and further provides a good match for energy transfer to the fuse site.

The instant invention also relates to a plasma fracturing system having an explodable conductor either in the form of a metal ribbon conductor wound as a helix or multiple helices around a mandrel or in the alternative a cup-shaped conductor. Both the ribbon and cup type explodable conductors have relatively large surface area to volume ratios to provide rapid heat dissipation from the explodable conductor site to rapidly release mechanical energy thereby fracturing of surrounding rock.

The desirable energy transfer characteristics from a relatively small capacitor bank can be further increased by placing a powdered metal and oxidant mixture in the immediate location of the explodable conductor. In the present invention, the preferred mixture is comprised of aluminum and water, although other powdered metals may be used. It has been found that the force of the explosion is considerably enhanced.

The interchangeable nature of the explodable conductor allows the same probe to be reused for a number of shots with relatively low expense. The cost of the other portions of the apparatus is kept low as relatively small capacitance banks, as opposed to the prior art, can be employed and providing relatively smaller current flows through the cables into the probe and back out, thereby allowing conventional cabling networks to be used which reduces the cost of the apparatus.

DETAILED DESCRIPTION OF THE PREFERRED EMBODIMENTS

Figure 1:
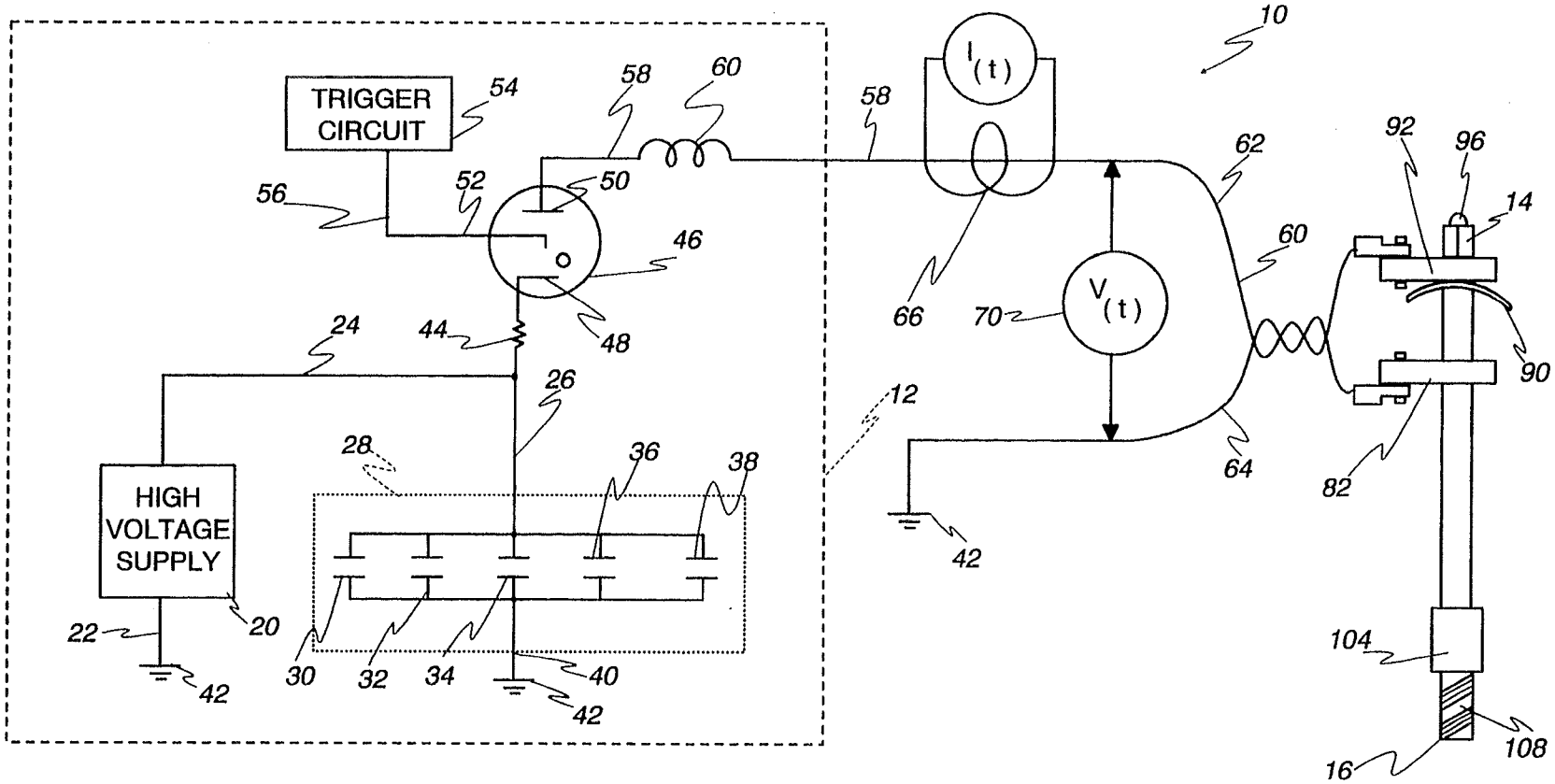
FIG. 1 is a schematic diagram of apparatus for plasma fracturing embodying the present invention.

Referring now to the drawings, and especially to FIG. 1, an apparatus for plasma blasting embodying the present invention is generally shown therein and identified by reference numeral 10. The apparatus for plasma blasting 10 includes a driver circuit for supplying pulsed high current, high voltage energy to a blasting probe 14 adapted to be placed in a rock formation. The probe 14 has removably electrically coupled to it a matched removable explodable conductor 16.

In order to supply energy to the driver circuit 12 a conventional high voltage supply 20 is connected thereto via a ground lead 22 and a lead 24. A lead 26 is coupled to capacitive or capacitance means 28 comprising a capacitor bank having capacitors 30, 32, 34, 36 and 38 for storing electrical energy. The total capacitance of the capacitor bank 28 is 4190 microfarads at a nominally peak rated voltage of 11,000 volts. A ground lead 40 connects the capacitance bank 28 also to a ground 42 to which the ground lead 22 is also connected. The high voltage supply 20 charges the capacitance bank 28 to a high potential, for instance 5 kilovolts or 10 kilovolts. The stored charge may then be released as a current pulse through other portions of the driver circuit 12 to the probe 14. The driver circuit 12 has a distributed resistance of 22 milliohms as exemplified by the distributive resistance symbol 44. The current pulse is produced by current flowing through the lead 26 and switch means comprising an ignitron 46 having a cathode 48, an anode 50 and a control electrode 52. The ignitron 46 selectively couples the electrical energy from the capacitor bank 28 to the explodable conductor 16. It controls the flow of current and is itself controlled by a trigger circuit 54 connected through a lead 56 to the trigger 52. When the trigger electrode 54 supplies a potential to the ignitron trigger 52, the current pulse flows through the ignitron 46 and through a lead 58 to the probe 14. Inductive means comprising a distributed inductance of 147 microhenries of the driver circuit 12 is represented by an inductor 60. The distributed inductance 60 receives the current and slows the rate of change of the current supplied to the explodable conductor 16. The slowed current pulse is supplied over the lead 58 which is coupled to a twisted pair 60 comprised of conventional 0000-gauge welding cable and having a first cable 62 and a second or grounded cable 64. Current flowing through the lead 58 to the cable 62 is sensed by a Rogowski coil 66 inductively coupled to the lead 58 for the measurement of the current flow through the lead 58 to the probe 14. Voltage across the probe 14 is effectively measured by a voltage measuring apparatus 70 connected between the cables 62 and 64. The cable 64 is grounded to the common ground 42 to provide a current return path to the capacitor bank 28.

Figure 2:
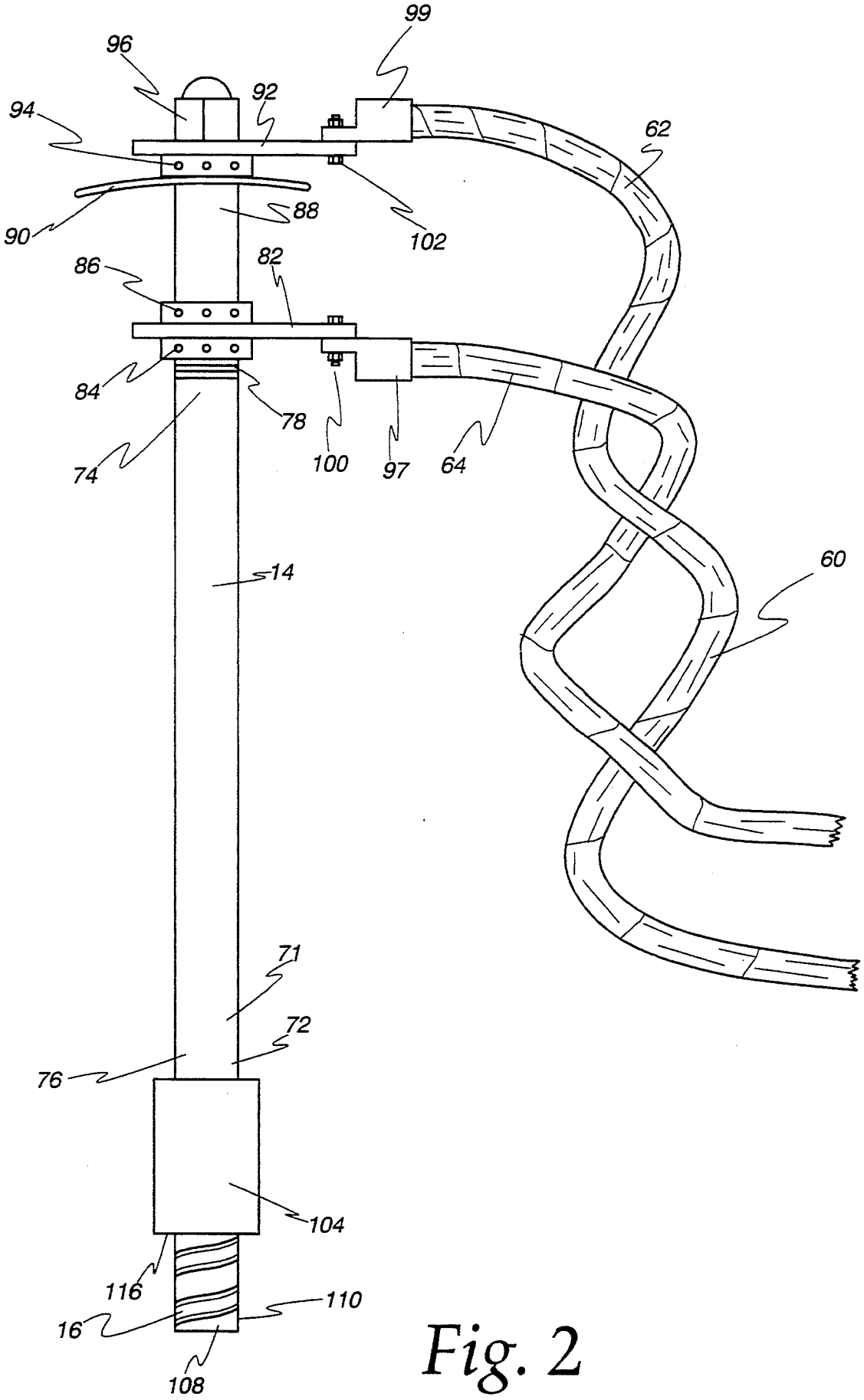
FIG. 2 is a side elevational diagram of a probe of the apparatus for plasma fracturing shown in FIG. 1 and showing details thereof.

As shown in more detail in FIG. 2, the electrical blasting probe 14 coaxial electrodes, having an overall length of 42.75 inches. The bulk of an outer ground return conductor 71 comprises a cylindrical steel pipe 72 having a 2.875 inch outer diameter. A pair of ends 74 and 76 of the steel pipe 72 are threaded at portions 78 and 80, respectively, to be connected electrically to the driver circuit 12. At the top end 74 of the steel pipe 72 an aluminum current spreading plate 82 is fastened with a brass spanner nut 84 threaded below the aluminum plate 82 and a brass spanner nut 86 threaded above the aluminum plate 82. An oversized four inch long high voltage insulated stand-off 88 is positioned above the steel pipe 72 and the brass spanner nut 86, and a polyethylene flash shield 90 provides additional electrical insulation for a second aluminum current spreading plate 92 fastened between a spanner nut 94 and an acorn nut 96 connecting an inner tubular brass high voltage electrode 98, shown in cross section in FIG. 4. The flash shield 90 provides added insulation in the event that unexpectedly high voltages are generated as the exploding conductor 16 opens.

The, twisted pair 60 is connected with conventional welding cable lugs 97 and 99 to the aluminum current spreading plates 82 and 92 by bolt-nut pairs 100 and 102, respectively, which provide means for receiving electrical current to deliver electrical energy to the blasting probe 14. An outer steel restrainer collar/ground electrode 104 is threaded to the bottom of the steel pipe 72. The ground electrode 104 makes electrical contact with the explodable conductor 16.

The explodable conductor 16 is a metal ribbon wound as a helix on a mandrel 108, forming a fuse cartridge 110. The mandrel 108 is a 4.5 inches long cylindrical pipe comprised of PVC, however, any insulative material such as a Dixie cup on which to wind the explodable conductor 16 will suffice. Alternately, the ribbon explodable conductor 16 could be replaced by a metal cup.

Figure 4:
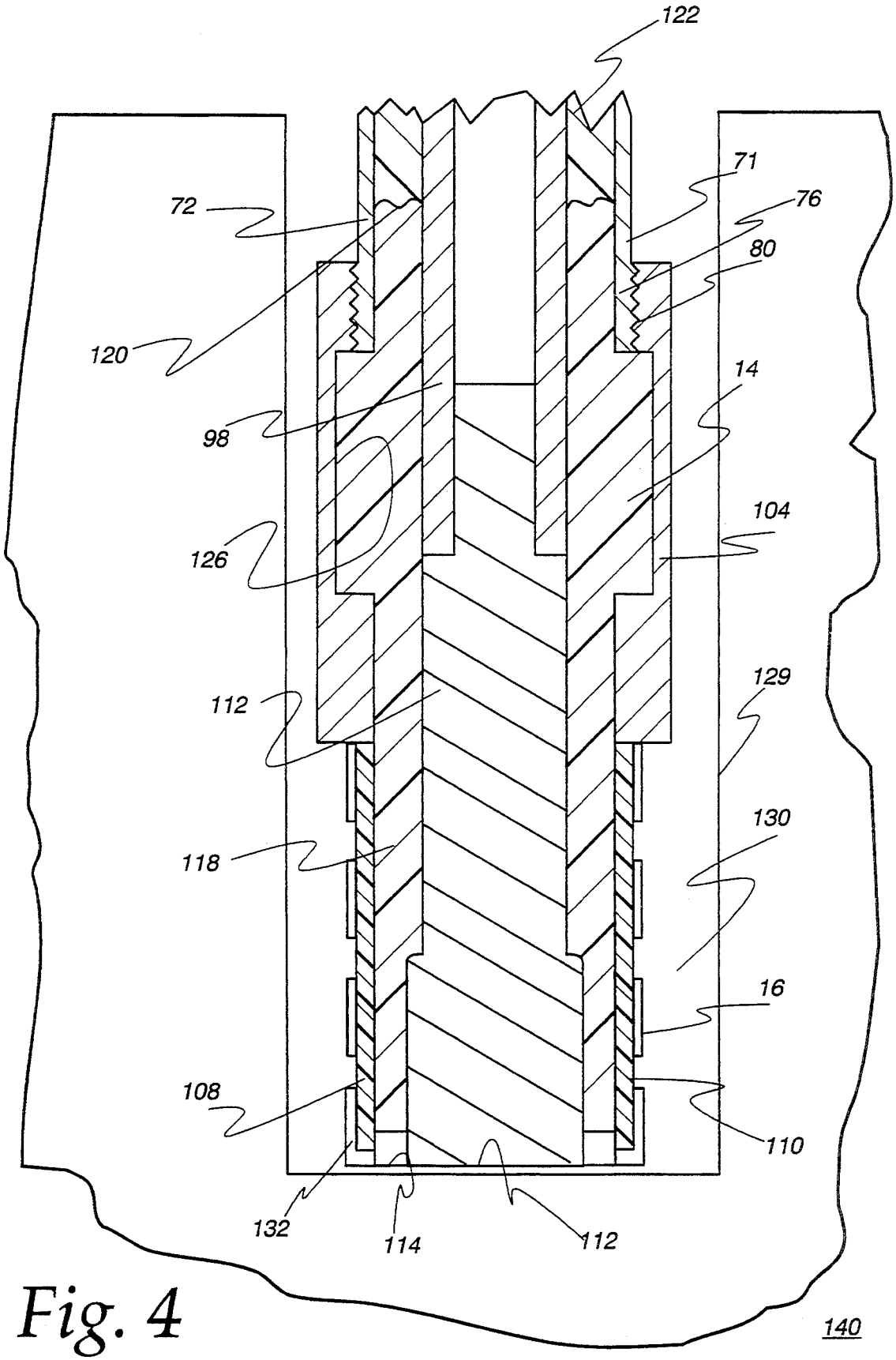
FIG. 4 is a partial sectional view of the probe shown in FIG. 2 having a removable fuse cartridge thereon positioned in a bore hole prior to firing.

As shown in FIG. 4 the tubular brass high voltage electrode 98 extends from the top of the blasting probe 14 to the lower portion, where a steel high voltage electrode tip 112 is press-fit into the tubular brass high voltage electrode 98 to effect good electrical connection via a flexible circular copper sheet end piece 114 with the explodable conductor 16. A ground contact end 116 of the collar/ground electrode 104 provides electrical contact to the explodable conductor 16 for ground return.

A G-10 fiberglass insulator 118 is disposed coaxially between the inner high voltage electrode and the outer ground return electrode. In the embodiment, the G-10 fiberglass insulator 118 extends from the bottom end portion of the probe 14 up about 18 inches, where a lap joint 120 provides an interface to a cylindrical Delrin acetal polymer insulator 122 extending coaxially within the cylindrical steel pipe 72 to an oversized high voltage standoff 124 at the top end of the blasting probe 14.

The steel restrainer collar/ground electrode 104 provides a stepped shoulder region 126 where the G-10 fiberglass insulator 118 becomes wider and is thus mechanically captured by the steel restrainer collar/-ground electrode 104. The capturing of the G-10 fiberglass insulator 118 at the bottom end of the blasting probe 14 and the use of the cylindrical acetal polymer insulator 122 at the top end of the blasting probe 14 joined at the lap joint 122 provides a coaxial insulator assembly which is able to survive the blast and be reusable.

The widening of the blasting probe 14 at the end of the steel restrainer collar/ground electrode 104 defines a confined area within the drill hole 129 wherein an annulus or explodable conductor region 130 may contain the working fluid as described further below. Alternatively, the working fluid may be contained within the confined area of the explodable conductor 16.

Figure 3A:
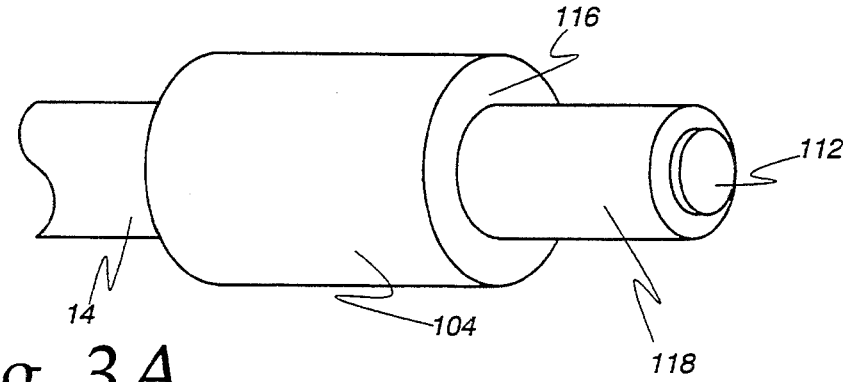
FIG. 3A is an isometric view of a probe tip of the probe shown in FIG. 2 without a removable explodable conductor comprising an interchangeable fuse cartridge fitted thereon.
Figure 3B:
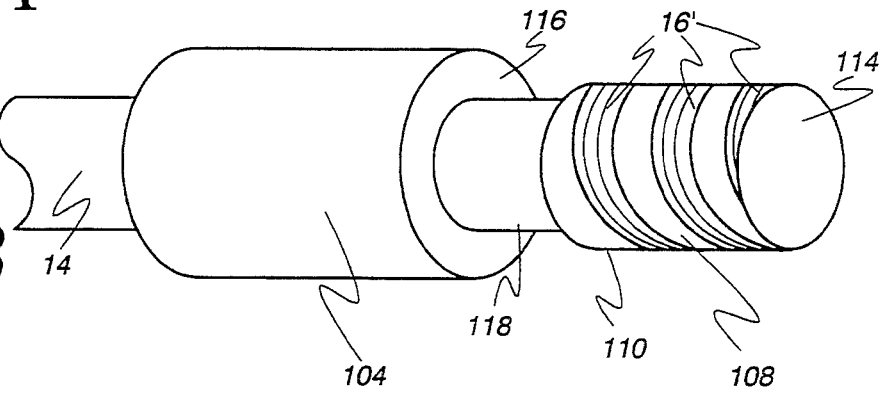
FIG. 3B is an isometric view of the probe tip shown in FIG. 3A showing details of the manner in which a removable explodable conductor comprising a removable fuse cartridge having a single conductor winding is fitted over the probe tip to be electrically coupled therewith.
Figure 3C:
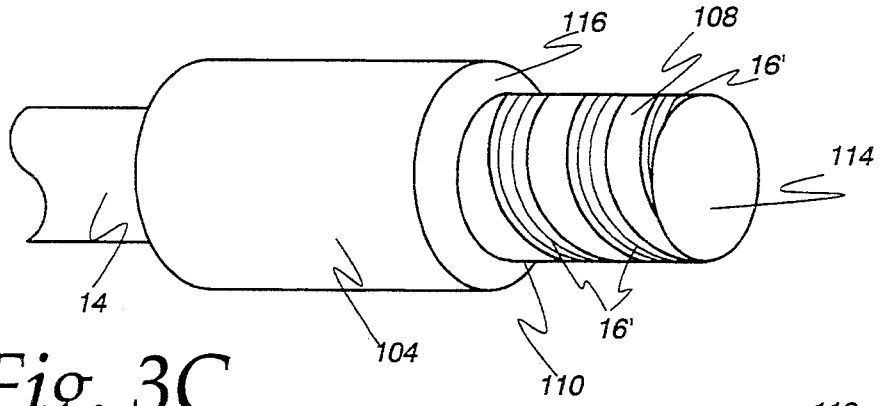
FIG. 3C is an isometric view of the probe tip shown in FIGS. 3A and 3B having the single winding removable fuse cartridge positioned thereon.

As may best be seen in FIG. 3A, the steel high voltage electrode tip 112 extends a small distance from the G-10 fiberglass insulator 118. As is shown in FIG. 3B, the mandrel 108 the explodable conductor 16 connected at an end 132 to the circular end piece 114. As is shown in FIG. 3C, the explodable conductor 16 is positioned in electrical connection both with the ground contact end 116 and the steel high voltage electrode tip 112 that pushes outward against the circular end piece 114. The sheet circular end piece 114 closes off one end of a section of the mandrel 108 and is comprised of flexible copper sheet to assure good electrical contact at both ends of the explodable conductor 16.

Figure 3D:
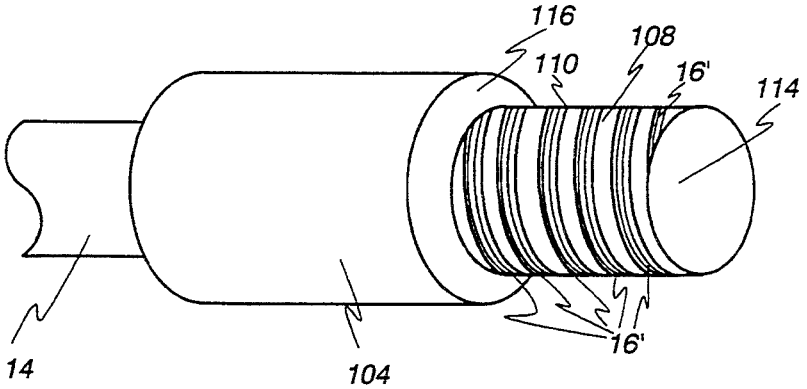
FIG. 3D is an isometric view of the probe tip shown in FIGS. 3A through 3C and having a multiple winding removable fuse cartridge thereon with a multiple turn fuse formed thereon.

As is shown in FIG. 3D, multiple explodable conductors 16' each comprise a metal ribbon that is helically wound about the mandrel 108 parallel with the other ribbons 16'. An assembly of two or more ribbons so configured was tested in Example V as set forth hereafter, which describes the use of four parallel ribbons 16' to encourage more intimate contact between explodable conductors 16' and a reactive working fluid. The explodable conductors 16 and 16' comprise various length strips of 5.5 mil thick aluminum foil which are folded lengthwise to a 0.75 inch resulting width.

Figure 5:
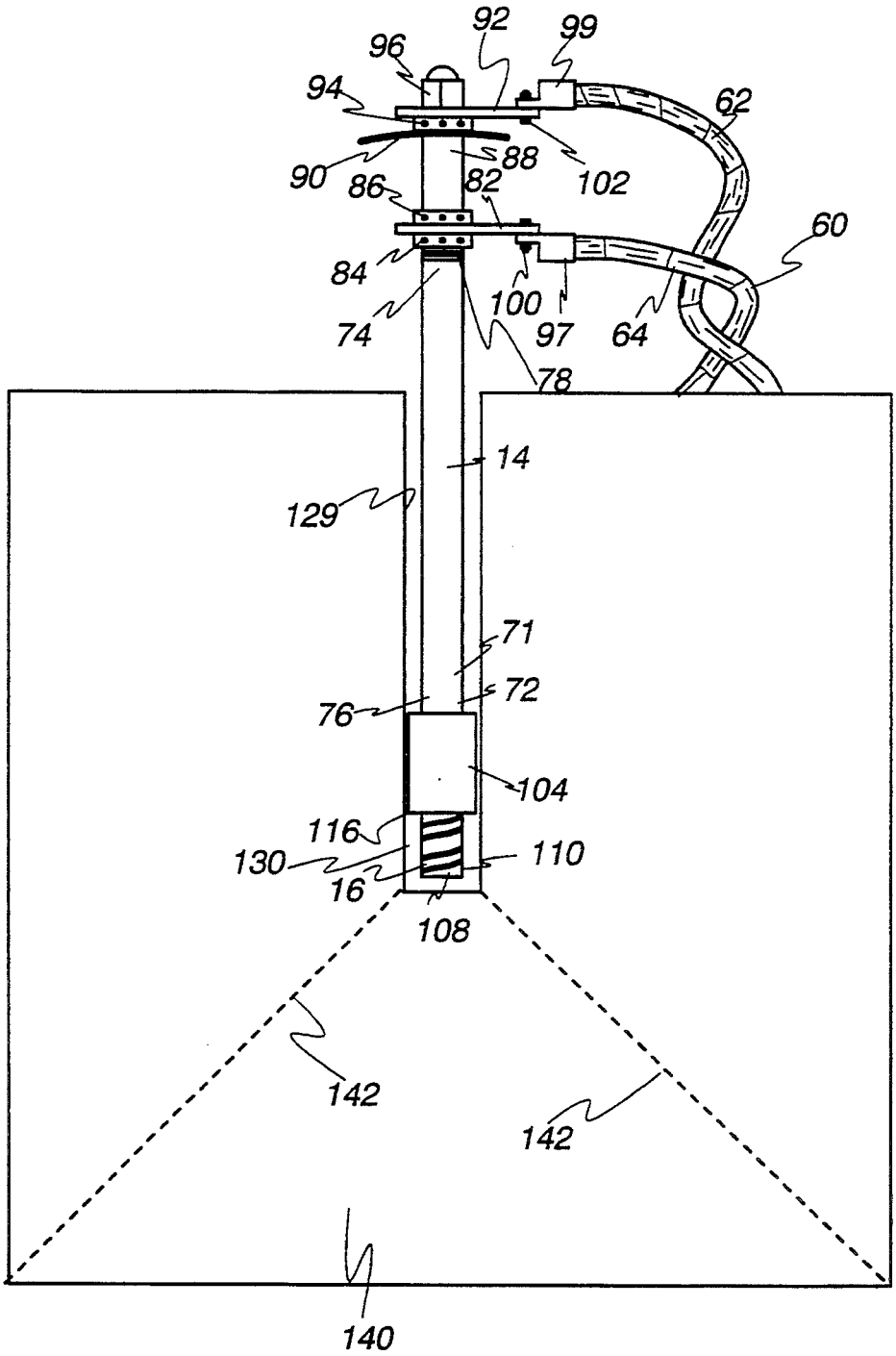
FIG. 5 is a partial sectional view of a block having the probe and fuse cartridge shown in FIG. 2 positioned thereon with the fracture lines that would result from firing the probe shown as dotted lines.
Figure 6A:
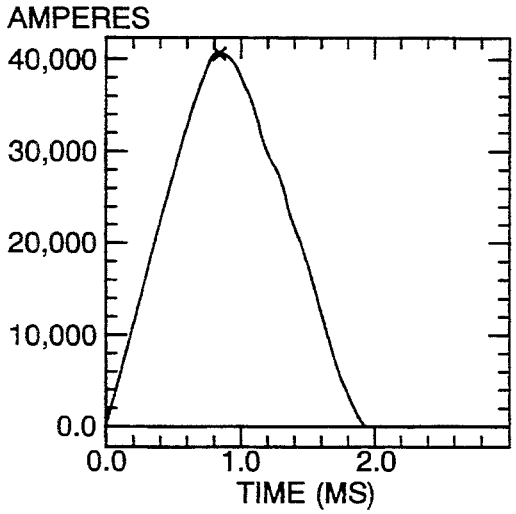
FIG. 6A is a graph of the current in tens of thousands of amperes through the probe with respect to time in milliseconds for Example 1.
Figure 6B:
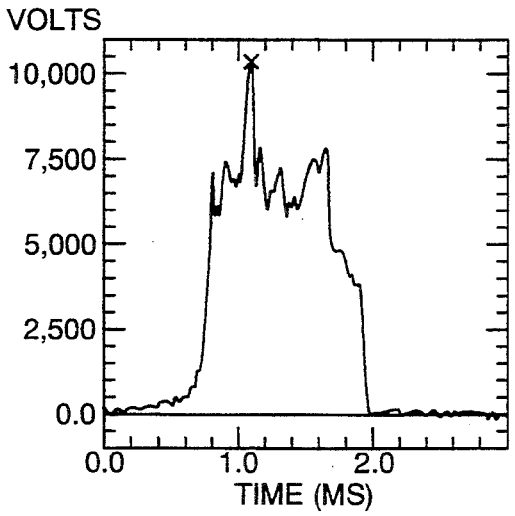
FIG. 6B is a graph of the potential drop in volts across the probe with respect to time in milliseconds for the test of Example 1.
Figure 6C:
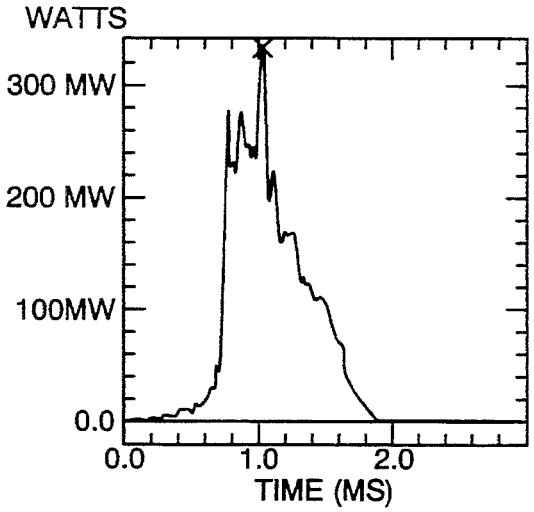
FIG. 6C is a graph of the power in megawatts transferred to the probe with respect to time in milliseconds for the test of Example 1.
Figure 6D:
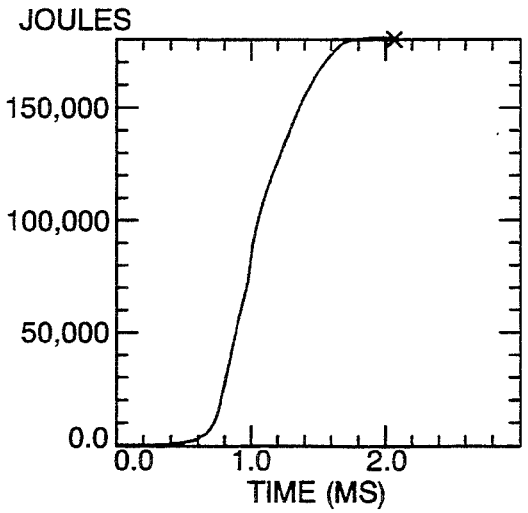
FIG. 6D is a graph of the energy in joules transferred to the probe with respect to time in milliseconds for the test results of Example 1.
Figure 7A:
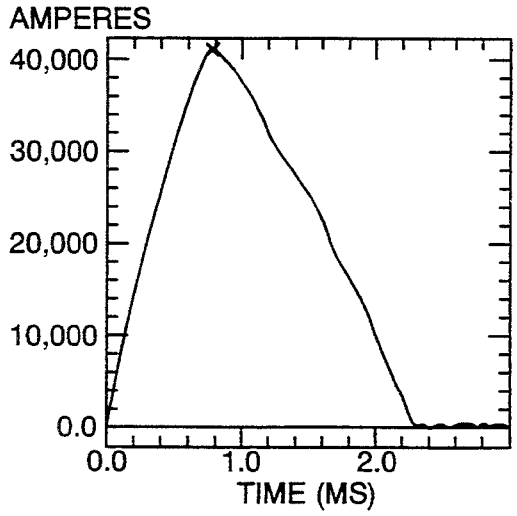
FIG. 7A is a graph of the current through the probe in tens of thousands of amperes with respect to time for the test results of Example 2.
Figure 7B:
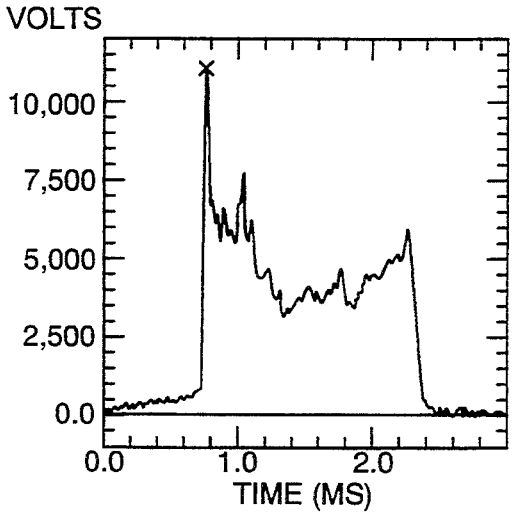
FIG. 7B is a graph of the potential drop across the probe in volts with respect to time in milliseconds for the test of Example 2.
Figure 7C:
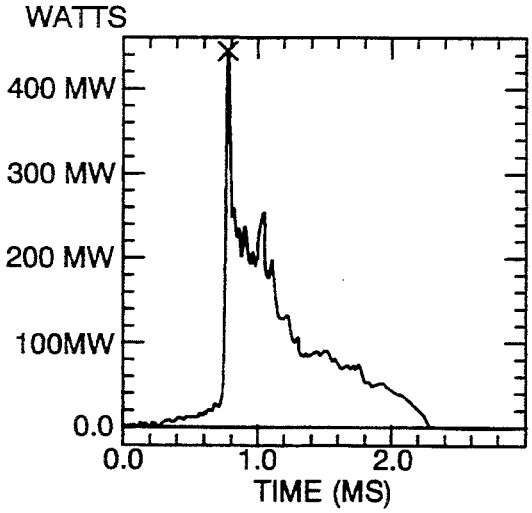
FIG. 7C is a graph of the power transferred to the probe in megawatts with respect to time in milliseconds for the test of Example 2.
Figure 7D:
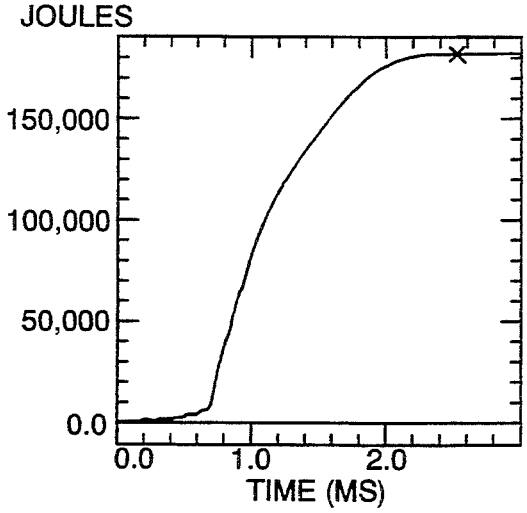
FIG. 7D is a graph of the energy transferred to the probe in joules with respect to time in milliseconds for the test of Example 2.
Figure 8A:
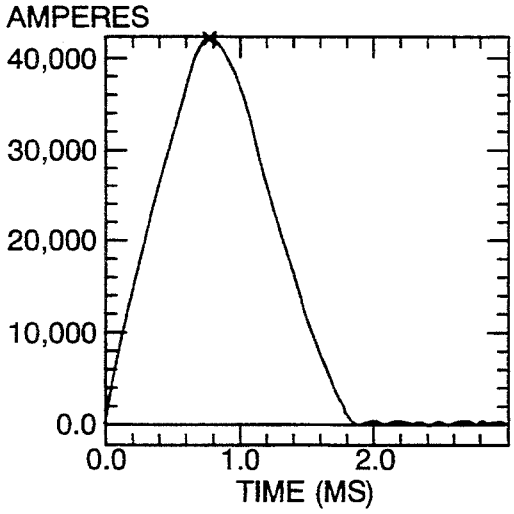
FIG. 8A s a graph of the current through the probe in tens of thousands of amperes with respect to time for the test results of Example 3.
Figure 8B:
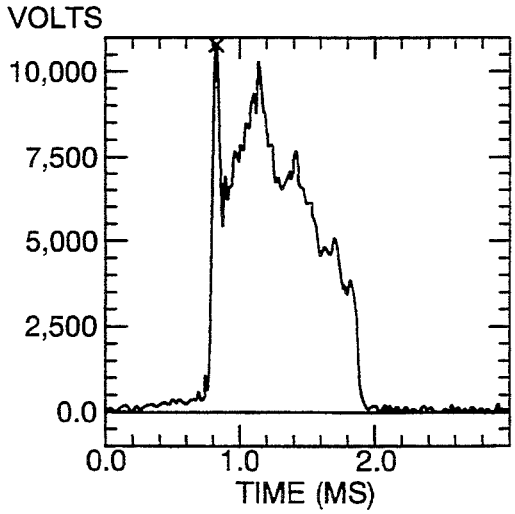
FIG. 8B s a graph of the potential drop across the probe in volts across the blasting probe with respect to time in milliseconds for the test of Example 3.
Figure 8C:
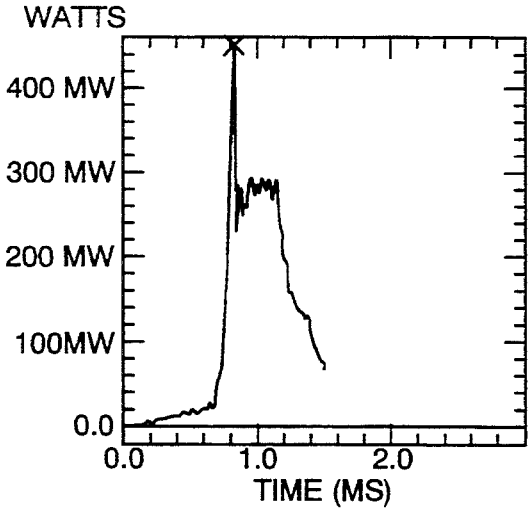
FIG. 8C is a graph of the power transferred to the probe in megawatts with respect to time in milliseconds for the test of Example 3.
Figure 8D:
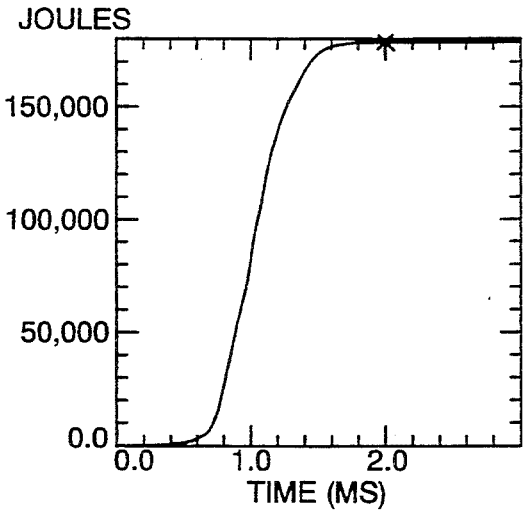
FIG. 8D is a graph of the energy transferred to the probe in joules with respect to time in milliseconds for the test of Example 3.
Figure 9A:
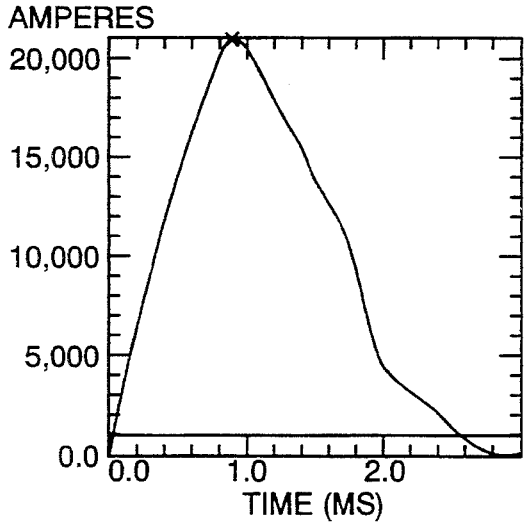
FIG. 9A is a graph of the current through the probe in tens of thousands of amperes with respect to time for the test results of Example 4.
Figure 9B:
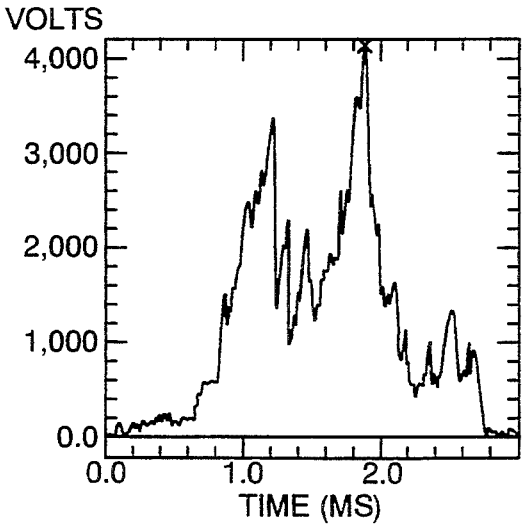
FIG. 9B is a graph of the potential drop across the probe in volts with respect to time in milliseconds for the test of Example 4.
Figure 9C:
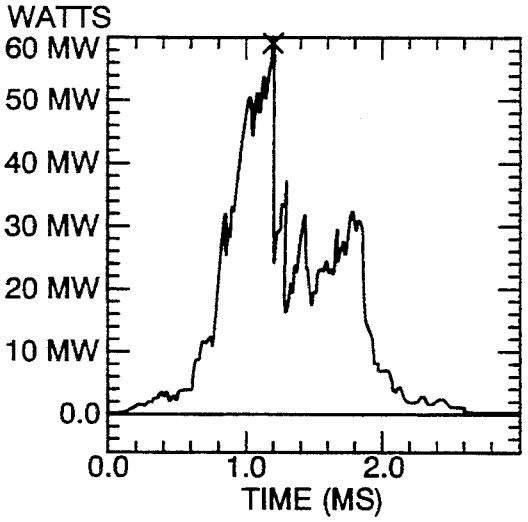
FIG. 9C is a graph of the power transferred to the probe in megawatts with respect to time in milliseconds for the test of Example 4.
Figure 9D:
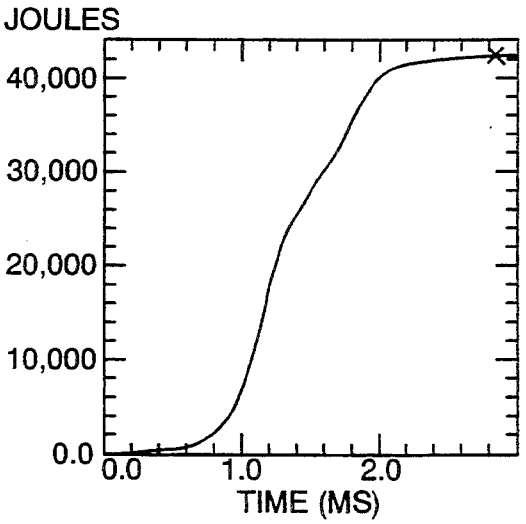
FIG. 9D is a graph of the energy transferred to the probe in joules with respect to time in milliseconds for the test of Example 4.
Figure 10A:
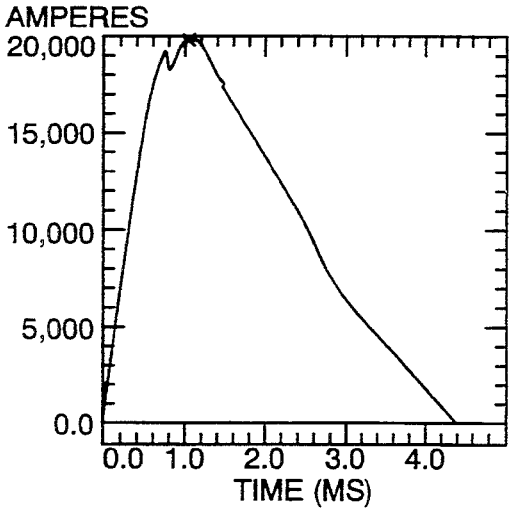
FIG. 10A is a graph of the current through the probe in tens of thousands of amperes with respect to time for the test results of Example 5.
Figure 10B:
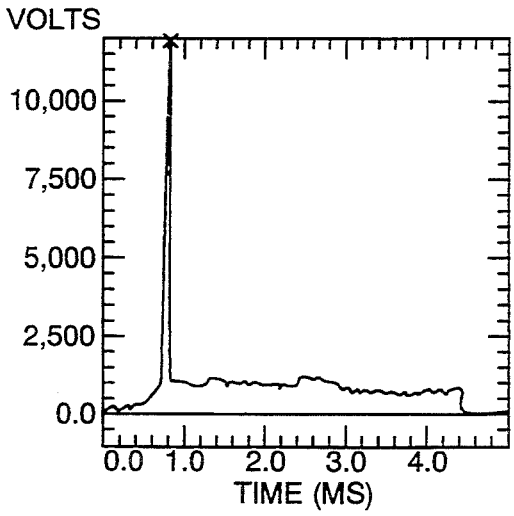
FIG. 10B is a graph of the potential drop across the probe in volts with respect to time in milliseconds for the test of Example 5.
Figure 10C:
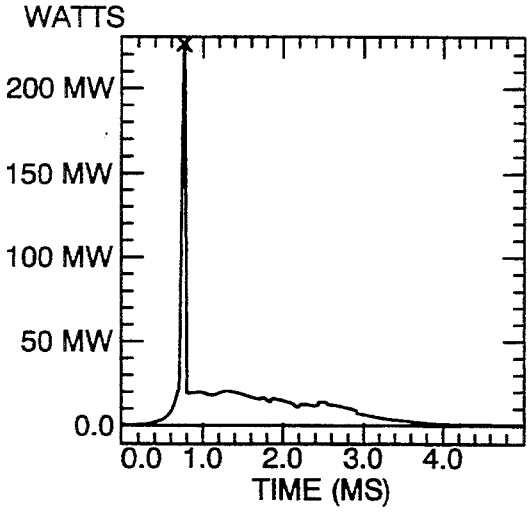
FIG. 10C is a graph of the power transferred to the probe in megawatts with respect to time in milliseconds for the test of Example 5.
Figure 10D:
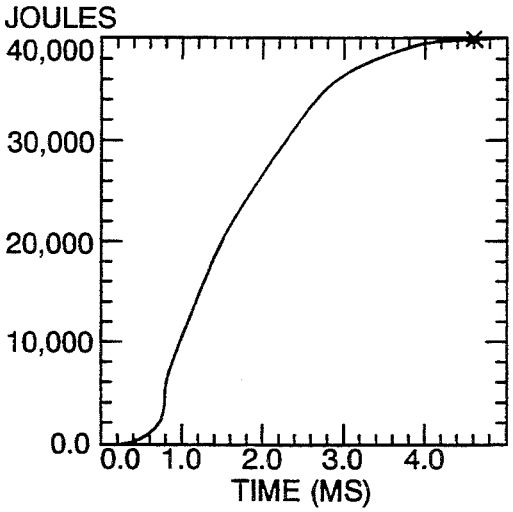
FIG. 10D is a graph of the energy transferred to the probe in joules with respect to time in milliseconds for the test of Example 5.
Figure 11A:
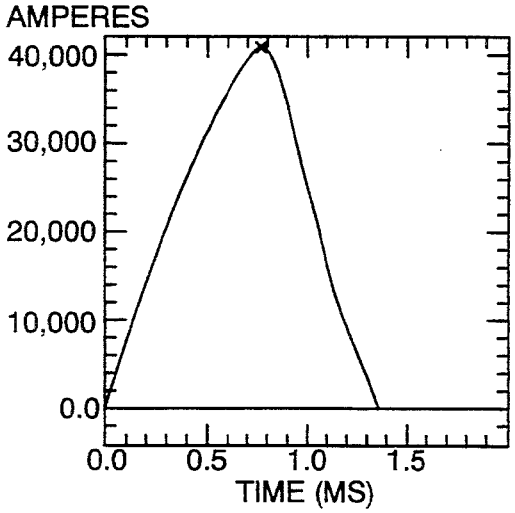
FIG. 11A is a graph of the current through the probe in tens of thousands of amperes with respect to time for the test of Example 6.
Figure 11B:
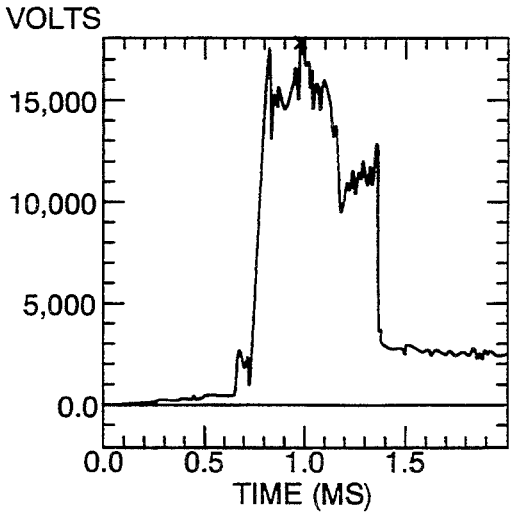
FIG. 11B is a graph of the potential drop across the probe in volts with respect to time in milliseconds for the test of Example 6.
Figure 11C:
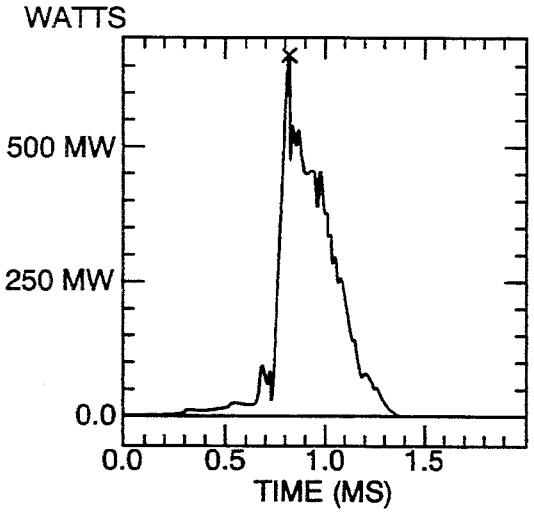
FIG. 11C is a graph of the power transferred to the probe in megawatts with respect to time in milliseconds for the test of Example 6.
Figure 11D:
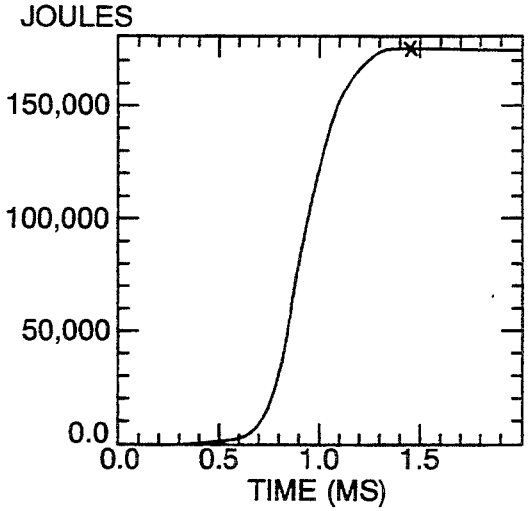
FIG. 11D is a graph of the energy transferred to the probe in joules with respect to time in milliseconds for the test of Example 6.

As shown in FIG. 5 the electrical blasting probe 14 is emplaced in a 37-inch cube, high strength (10,000 psi) concrete test sample 140. Such concrete test samples were used in the examples III–VI set forth below. A dashed line 142 represents a conical fracture surface which one would expect to observe if cracks were launched uniformly outward from the stress-enhanced inside corner of the circular hole having walls which intersect at right angles as shown. Such "base cones" or "volcanoes" were invariably found among the pieces following a test. The most symmetric cones were obtained from the highest energy shots.

The working fluid may be placed in the drill hole 129 at the annulus 130 to receive heat from the explodable conductor 16 to perform pressure-volume (pV) work for rock cracking. Since water is employed as a working fluid its also is a source of oxygen and acts as an oxidizer or oxidant for exothermic reactions with powdered metal such as aluminum that may be used to chemically augment the plasma fracturing of the rock.

The lower end of the probe 14 extends approximately 19 inches into the concrete test sample and the hole 129 drilled therein has a diameter of 2.88 inches, which is the bore produced by a standard rock drill. The overall diameter of the blasting probe 14 is 2.875 inches at the steel restrainer collar/ground electrode 40, slightly less than the hole diameter. The tight fit between the blasting probe 14 and the drill hole 129 prevents blow-by of the working fluid contained in the annular region of annulus 130 during an explosion.

In the chemically augmented embodiments, the annulus 130 is filled with a gelling agent such as Knox gelatine mixed with water and a fine suspended aluminum powder. Alternatively, other metal powders such as titanium or iron which exothermically react with water providing a rapidly expanding gas will also be an acceptable fuel in accordance with the invention.

The released energy density of the chemical reaction of the aluminum-water mixture driven the exploding fuse, amounts to approximately 10 kilojoules per cubic centimeter of mixture. At this energy density approximately 0.5 megajoules of energy is evolved per linear inch of the mandrel 108. The capacitor bank energy is approximately 10 percent of the total energy released. Chemical augmentation is desired when the energy requirement is high and eliminates the need for blasting with high explosives. The aluminum-water mixture functions as a fuel or energetic propellant. The energy is released via a local phenomenon in the vicinity of the fuse, rather than a self-propagating chemical reaction. When the aluminum and water are heated by the exploding fuse and plasma they react exothermically to produce hydrogen that rapidly expands and provides mechanical energy for rock fracturing in the drill hole.

When the energy needed for rock cracking is not large, a more basic embodiment eliminating the energetic propellant and replacing it with an inert working fluid (gelled water) may be desirable. In this embodiment, the blasting mechanism used is purely a plasma generated when the fuse is exploded within a mixture which disassociates into gas constituents allowing the plasma to be created.

As mentioned above, the explodable conductor is properly matched with the driven circuit 12 to provide efficient energy transfer, facilitating hard rock mining with moderately high energy electrical discharges on the order of tens of kiloamperes. The proper matching enables the explodable conductor 16 to convert from solid to plasma at peak current of the current pulse. The distributed inductance 60 then causes the current to be further boosted by the impedance jump that occurs when the conductor changes from its relatively low impedance solid state to a higher impedance plasma state. The higher impedance at the explosion site also causes more energy to be dissipated at the annulus 130.

Fuse volume and relative impedance are two criteria optimized according to the equations below. As can be seen from the equations, fuse length (l), which is measured in the direction of current flow and cross-sectional area (A), which is measured transverse to current flow, are determined such that the fuse volume (lA) is proportional to stored energy $\int I^2(t)dt$, where I(t) is the above described current pulse. Also, the fuse relative impedance (l/A) should be proportional to the impedance of the energy source. The dimensions of the fuse are determined according to the following relations where l is fuse length and A is cross section:

1. fuse volume stored energy $$\text{i.e., } lA \propto CV^2$$

2. fuse relative impedance ∝ circuit impedance $$\text{i.e., } \frac{l}{A} \propto \sqrt{\frac{L}{C}}$$

From these relations, we may derive the fuse length, l and the fuse cross section, A as follows:

$$l = k_1(LC)^{\frac{1}{4}}V$$

$$A = k_2C^{\frac{3}{4}}L^{-\frac{1}{4}}V$$

where $k_1$ and $k_2$ are constants, empirically-determined for each material. The following values have been found optimal, producing a high degree of electrical power amplification, together with efficient coupling of electrical energy to the fuse:

For Aluminum:

$$k_1 = 1.8\times10^{-1}\ \text{cm/(volt-sec}^{\frac{1}{2}})$$

$$k_2 = 3.6\times10^{-5}\ \text{cm}^2\text{/(amp-sec}^{\frac{1}{2}})$$

For Copper:

$$k_1 = 2.3\times10^{-1}\ \text{cm/(volt-sec}^{\frac{1}{2}})$$

$$k_2 = 1.6\times10^{-5}\ \text{cm}^2\text{/(amp-sec}^{\frac{1}{2}})$$

The explodable conductor cross section should be made close to the values calculated above, in order to have explodable conductor explosion occur at nearly peak current. It should be appreciated that the dimensions of a given explodable conductor optimized for particular operating conditions, as described above, may also be scaled to alternative physical dimensions (l, A). The fuse length l is much less critical, and may vary by a factor of two from the optimal value with little change in performance. In each of the embodiments, the explodable conductor 16 has a relatively large surface area to volume ratio to enhance energy transfer to the working fluid.

EXAMPLE 1

The apparatus 10 was tested at full electrical and chemical power into a sand-filled cardboard box. The working fluid was a 50:50 (by weight) mixture of 3 micrometer aluminum powder and water with 1 percent gelatin added to keep the aluminum in suspension. The same working fluid was used for all of the following examples except Example 6, which used pure water as an inert working fluid. The working fluid volume in the present example consisted of an annulus of 2.5 inches mean diameter, 0.25 inches thick and 4.5 inches long, holding 211 grams of mixture which, under complete reaction, would release 1.5 megajoules of chemical energy. The explodable conductor 16 comprised a 1.5 inches wide, 20 inches long strip of 5.5 mil thick aluminum foil. The foil was folded lengthwise to a 0.75 inch resulting width and wound as a helix upon a PVC mandrel 108, providing fairly intimate contact with the working fluid (water). The capacitor bank 28 was charged to 10 kilovolts, storing 209.5 kilojoules of electrical energy. Of this, 179.4 kilojoules was coupled to the fuse at a peak power of 336 megawatts. A Delrin acetal polymer insulator extended for the entire length of the tube. The acetal polymer insulator was fractured at the output end. The electrical current, voltage, power and energy versus time at the apparatus are shown graphically as FIGS. 6A, 6B, 6C and 6D, respectively.

EXAMPLE 2

All conditions were nominally identical to Example 1 except that because the acetal polymer insulator had been fractured at the output end a lap joint was made in the insulator and the last 18 inches was replaced with an insulation portion comprised of G-10 fiberglass. Electrical performance was similar (see FIGS. 7A, 7B, 7C and 7D), subject to the random variations inherent in the fuse 42. A peak power of 442 megawatts was observed and a total of 182.3 kilojoules was coupled. The apparatus with the G-10 fiberglass insulator survived and was reusable.

EXAMPLE 3

The conditions of the capacitor bank 28, blasting probe 14, working fluid and explodable conductor 16 were identical to those of Example 2. The peak rate of electrical power transfer was 450 megawatts. A total energy of 178.3 kilojoules was coupled to the fuse (see FIGS. 8A, 8B, 8C and 8D.) This time, instead of blasting into a box of sand, the apparatus 10 blasted a concrete test sample, as depicted in FIG. 5. The violence of the blast was significant. The concrete test sample was fractured into at least 23 pieces, whose maximum linear dimensions range from 10 inches to 35 inches, mean ± standard deviation was 19 inches ±7 inches. Numerous smaller pieces were also produced. Some of the larger pieces were thrown about 30 feet from the test area.

EXAMPLE 4

An annular steel extension was made for the steel restrainer collar/ground electrode, reducing the length of the explodable conductor/working fluid region from 4.5 inches to about 1.5 inches. This reduced the maximum available chemical energy to 500 kilojoules. The electrical energy output was scaled down by a factor of 4, corresponding to 5 kilovolts on the capacitor bank which is half of the nominal fully charged voltage. The length of the explodable conductor 16 also was scaled down by a factor of 2, to 10 inches. Its width, and hence cross section, was likewise halved to 0.75 inches while its thickness remained the same as the fuse used in Examples 1 through 3. The explodable conductor 16 was properly matched to the driver circuit 12 characteristics. The only change in the initial conditions of the capacitor bank was in voltage V. Therefore, from the relations $l \propto (LC)^{\frac{1}{4}}V$; $A \propto C^{\frac{3}{4}}L^{-\frac{1}{4}}V$, both l and A were reduced to one-half their previous values. As expected from the reduced electrical energy stored in the capacitor bank 28, the explosion was considerably less violent than that of Example 3 because only 52.4 kilojoules of electrical energy was stored in the capacitor bank and 42.5 kilojoules was coupled to the explodable conductor 16. Peak electric power was 59.6 megawatts. See FIGS. 9A, 9B, 9C, and 9D. Interestingly, the concrete test sample was broken into four large pieces with only a stored energy of 52.4 kilojoules.

EXAMPLE 5

The capacitor bank was charged to 5 kilovolts and the full 4.5 inches of working fluid was employed to determine whether only 52.4 kilojoules of stored energy could be used to release chemical energy via the aluminum-oxygen reaction. The explodable conductors 16' had the same length and thickness as the explodable conductor 16 used in Example 4 because it was still required to couple the 5 kilovolt bank. To encourage more intimate contact between the explodable conductor and the reactive fluid, four parallel, 3/16 inch wide explodable conductor ribbons or strips 16', each 10 inches long, which were wound as four parallel helices upon a 4.5 inches long PVC mandrel 108, resulting in approximately 1 inch between adjacent strips 16'. Example 5 was successful in enhancing energy output, breaking the test sample into 10 large pieces. The electrical performance of the new explodable conductor geometry as shown in FIGS. 10A, 10B, 10C and 10D, however, was somewhat different from the previous examples. A high voltage appeared across the explodable conductors initially, corresponding to a peak power of 224 megawatts, but this voltage quickly collapsed, possibly due to turn-to-turn flashover in the multi-turn explodable conductor. The total electrical energy coupled was 40 kilojoules out of 52.4 kilojoules initially stored.

EXAMPLE 6

The capacitor bank 28 was charged to 10 kilovolts and the single helix 20 inches long explodable conductor 16, 5.5 mil thick, 1.5 inches wide, the fuse was wound on a 4.5 inches long mandrel 108. The working fluid was pure water having no aluminum therein, thus providing no chemical augmentation to the plasma energy release. The higher dielectric constant of water as compared with the aluminum loaded water, increased the effective impedance of the plasma thereby leading to the generation of a high sustained voltage drop at the fuse with good power dissipation thereat. Peak power was 658 megawatts and 174.2 kilojoules of electrical energy was coupled to the fuse (see FIGS. 11A, 11B, 11C and 11D). The concrete test sample was fractured into 13 large fragments.

The table below provides a summary of Examples 1–6:

| EXAMPLE | CHARGE VOLTAGE (kV) | PEAK POWER (MW) | ENERGY STORED (kJ) | ENERGY COUPLED (kJ) | NUMBER OF FRAGMENTS |
|---|---|---|---|---|---|
| 1 | 10 | 336 | 209.5 | 179.4 | NA |
| 2 | 10 | 442 | 209.5 | 182.3 | NA |
| 3 | 10 | 450 | 209.5 | 178.3 | 23 |
| 4 | 5 | 59.6 | 52.4 | 42.5 | 4 |
| 5 | 5 | 224 | 52.4 | 40.0 | 10 |
| 6 | 10 | 658 | 209.5 | 174.2 | 13 |

It may be appreciated that while specific embodiments of the instant invention have been disclosed herein, the true spirit and scope of the instant invention shall be limited only by the appended claims.

What is claimed is:

1. Apparatus for plasma blasting a solid, comprising:

capacitive means for storing electrical energy;

an explodable conductor having a given length and cross-section and electrically coupled to said capacitive means to receive electric current, said electric current heating said explodable conductor from a solid to a plasma in proximity with a vaporizable working fluid to perform work on the solid;

switch means selectively coupling the electric charge potential from said capacitive means to said explodable conductor; and inductive means coupled to said capacitive means to receive the flow of electric charge and slow the rate of change of the electric current to the explodable conductor, the increase in resistance of the explodable conductor occurring when it changes from solid to plasma causing current to the plasma to produce an increased voltage drop across the plasma with resulting increased dissipation of heat to the working fluid, the square root of the ratio of the inductance of the inductive means divided by the capacitance of the capacitance means being proportional to the ratio of the length of the explodable conductor divided by its cross section and the volume of the explodable conductor being proportional to the electrical energy stored in said capacitive means in order to provide optimal energy transfer from the capacitive means to the explodable conductor.

2. Apparatus for plasma blasting a solid according to claim 1, wherein said explodable conductor comprises a sheet of conductive material having a relatively large surface area to volume ratio.

3. Apparatus for plasma blasting a solid according to claim 1, wherein said explodable conductor comprises a metal ribbon.

4. Apparatus for plasma blasting a solid according to claim 1, wherein said explodable conductor comprises a helical ribbon wound about a supporting body.

5. A method for plasma blasting a solid comprising the steps of:

charging a capacitance with an electric charge; and transferring the electric charge through an inductance to an explodable conductor, wherein the square root of the ratio of the inductance to the capacitance is proportional to a length of the explodable conductor divided by its cross sectional area and the volume of the explodable conductor is proportional to the electrical energy stored in the capacitor.

6. A method for plasma blasting a solid according to claim 5, further comprising the step of placing the explodable conductor in proximity with a powdered metal and oxidant mixture so that conversion of the explodable conductor to plasma causes the mixture to react and release heat energy to augment the explosive force of the explodable conductor.

7. A method for plasma blasting a solid according to claim 6, wherein said powdered metal comprises aluminum.

8. A method for plasma blasting a solid according to claim 7, wherein said oxidant comprises water.

9. A method for plasma blasting a solid according to claim 8, wherein a gelling agent is combined with said aluminum and said water to maintain the aluminum and water in proximity with the explodable conductor.

* * * * *